United States Patent [19]

Nakae et al.

[11] 3,977,868

[45] Aug. 31, 1976

[54] NITROGEN CONTAINING ADDITIVE FOR STRENGTHENING CAST IRON

[75] Inventors: Hideo Nakae, Kashiwa; Hitoshi Kiyosuke, Ibaraki; Senri Okada, Tokyo, all of Japan

[73] Assignee: Hitachi, Ltd., Japan

[22] Filed: Aug. 4, 1975

[21] Appl. No.: 601,663

[30] Foreign Application Priority Data

Aug. 16, 1974 Japan ..... 49-93286

[52] U.S. Cl. ..... 75/134 F; 75/130 R; 75/134 M; 75/134 S

[51] Int. Cl.[2] ..... C22C 30/00

[58] Field of Search ..... 75/134 F, 134 S, 134 M, 75/134 P, 130 R

[56] References Cited

UNITED STATES PATENTS

| | | | |
|---|---|---|---|
| 2,950,187 | 8/1960 | Ototani | 75/134 F |
| 3,177,072 | 4/1965 | Kaess et al. | 75/134 S |
| 3,304,175 | 2/1967 | Madsen | 75/134 P |
| 3,551,139 | 12/1970 | Schokkenbroek | 75/130 R |
| 3,717,456 | 2/1973 | Percheron et al. | 75/134 S |
| 3,891,432 | 6/1975 | Nakae | 75/130 R |

*Primary Examiner*—L. Dewayne Rutledge
*Assistant Examiner*—E. L. Weise
*Attorney, Agent, or Firm*—Craig & Antonelli

[57] ABSTRACT

A nitrogen containing additive for strengthening cast iron which contains silicon, calcium, nitrogen, at least one of chromium and manganese and the balance being iron and incidental impurities. Addition of said additive to flake graphite cast iron melt results in increase in tensile strength by 7 – 15 kg/mm$^2$ and hardness by 20 – 60 in Brinell hardness and reduction in depth of chill due to synergistic effect of the alloying elements contained in the additive.

3 Claims, 1 Drawing Figure

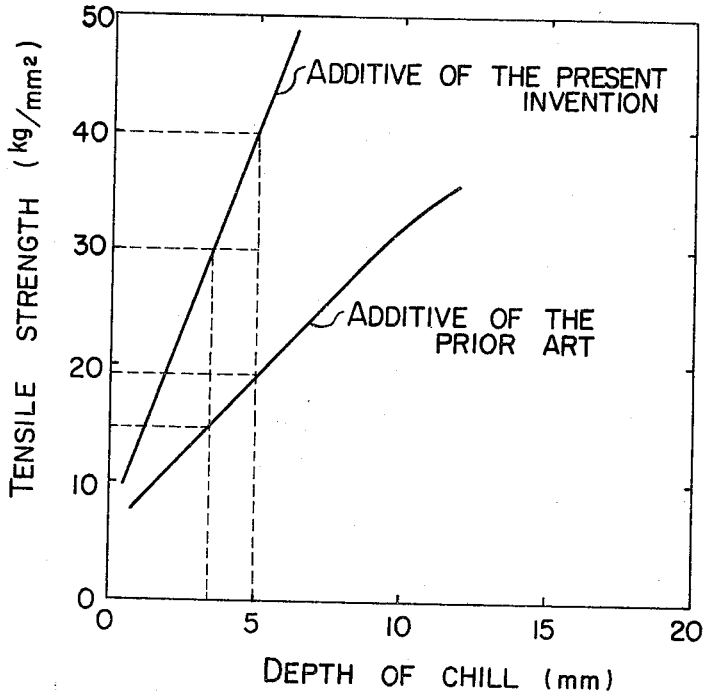
50
40
30
20
10
0
TENSILE STRENGTH (kg/mm²)
ADDITIVE OF THE PRESENT INVENTION
ADDITIVE OF THE PRIOR ART
0
5
10
15
20
DEPTH OF CHILL (mm)

NITROGEN CONTAINING ADDITIVE FOR STRENGTHENING CAST IRON

The present invention relates to a nitrogen containing additive for strengthening cast iron which improves mechanical properties such as tensile strength, etc. of flake graphite cast iron.

Conventionally, strong cast irons have been produced by controlling the chilling tendency and improving the shape of graphite by inoculation with lowering carbon and silicon contents. In this case, balance of the carbon and silicon contents to be aimed at is such as satisfying the formula C % = Si % + (0.7 – 1.5) and specifically, the contents are as shown in Table 1.

Table 1

| Cast irons | C, % | Si, % |
|---|---|---|
| Fc 15* | 3.5 – 3.8 | 2.3 – 2.8 |
| Fc 20 | 3.3 – 3.6 | 1.8 – 2.3 |
| Fc 25 | 3.2 – 3.5 | 1.7 – 2.2 |
| Fc 30 | 3.1 – 3.3 | 1.6 – 2.1 |
| Fc 35 | 2.9 – 3.2 | 1.5 – 2.0 |

*"Fc 15" means flake graphite cast iron having a tensile strength of more than 15 kg/mm² with 30 mmϕ as cast test in accordance with the Japanese Industrial Standard.

Other values have the similar meanings.

The conventional technique mentioned above is considered to attempt to improve tensile strength even with somewhat sacrificing the chilling tendency.

Furthermore, in the conventional technique, depth of chill (which means the value measured on forcedly chilled test pieces of 8 mm in thickness hereinafter) can be decreased, but tensile strength cannot be greatly improved (at most by 5 kg/mm²). Although depth of chill can be decreased by inoculation, it is considered that a decrease to about 7 mm in the case of Fc 30 is maximum. Further decrease in depth of chill can be attained by decreasing the carbon content and increasing the silicon content, but in this case formation of ferrite is accelerated to cause reduction in tensile strength. Therefore, low carbon content and high silicon content cannot be employed.

For improving mechanical properties of cast iron, reduction of carbon equivalent or addition of other alloying elements have been industrially carried out. Besides these processes for strengthening cast iron, addition of nitrogen has also been carried out. For example, nitrogen has been industrially used as an element for strengthening steels. In addition to such contribution of nitrogen for steel matrix, nitrogen improves shape of graphite in cast iron and is an element capable of markedly improving the mechanical properties of cast iron in this respect, too.

For example, potassium ferrocyanide and potassium ferricyanide have been proposed as nitrogn additives for improving tensile strength and toughness of cast iron. However, these nitrogen additives generate toxic gases (cyan gas) and are not preferred in operation. Addition of lime nitrogen (or calcum cyanamide) has also been proposed, but in this case not only the lime nitrogen per se is toxic for the human body, but also there is the possibility of generating cyan gas when added and furthermore, slag is produced and hence skimming is required. In addition, lime nitrogen has a high hydroscopicity and loses its effectiveness due to moisture absorption It is, therefore, an object of the present invention to provide an additive which, when added to cast iron melt, markedly improves mechanical properties of the cast iron such as tensile strength and decreases depth of chill.

It is another object of the present invention to provide an additive which, when added, does not damage operation atmosphere.

It is still another object of the present invention to provide an additive which requires no skimming operation.

The nitrogen containing additive for strengthening cast iron of the present invention is characterized by comprising 20 – 60% of silicon, 0.5 – 10% of calcium, 2 – 10% of nitrogen, 20 – 50% of at least one of chromium and manganese and the balance of iron and incidental impurities.

The effect of the additive becomes more remarkable when it comprises 25 – 35% of silicon, 1 – 8% of calcium, 1.0 – 5.0% of nitrogen, 35 – 45% of at least one of chromium and manganese and the balance of iron and incidental impurities.

As mentioned above, the additive of the present invention contains nitrogen and chromium or manganese which have strong action of stabilization of pearlite. Owing to the action of these elements, ferritization of iron matrix is restrained and the pearlite formation is accelerated.

The elements such as silicon, calcium, etc. which are potent graphite forming elements bring about chill preventing effect and simultaneously improve shape of graphite. Thus, these elements improve mechanical properties of cast iron.

According to the additive of the present invention, it has been found that when the matrix-strengthening elements and the graphitizing element coexist, synergistic effect by these elements is exhibited on improvements of mechanical properties. Mechanism of the synergistic effect has not yet been elucidated, but the presence of nitrogen seems to be one important factor.

Moreover, according to the additive of the present invention, it has become possible to lower the carbon content and increase the silicon content as compared with the components (as shown in Table 1) of the conventional cast iron and depth of chill can be decreased than that of the conventional cast iron with the same carbon equivalent.

Therefore, for example, when the additive of the present invention is added to a molten iron corresponding Fc 20, depth of chill becomes equal to or less than that of Fc 20 and a cast iron corresponding to Fc 25 – Fc 30 is obtained.

Furthermore, the additive of the present invention provides the following effects; when it is added to a cast iron having chemical compositions of low carbon content and high silicon content (for example 2.6% carbon and 3.0% silicon), even such cast iron as corresponding to Fc 40 can be obtained; in the case of a cast iron corresponding to Fc 30 – Fc 35, thin castings (for example, of 5 mm in thickness) can be obtained without cementite formation; price of the products becomes cheaper than addition of pearlite stabilizing elements such as nickel, copper and tin. Moreover, on reuse of the return materials such as feeder, gate and etc. this additive has no trouble with remaining of such alloying elements.

Furthermore, since the additive of the present invention has strong action for stabilization of pearlite, the additive is effective for improving conversion of matrix structure into pearlite and hardness even in such case as stack molding of shell mold where ferritization proceeds due to slow cooling after solidification and desired hardness cannot be obtained.

Furthermore, being different from other nitrogen additives, the additive of the present invention generates no toxic cyan gas when added to the molten iron and hence operation can be always carried out under good circumstances.

In addition, the additive of the present invention does not produce slag and so no skimming operation is required.

Reasons for restriction of each component will be explained below.

Silicon is an essential element for obtaining inoculation effect of the additive. When silicon content is less than 20%, effect of decreasing depth of chill is low and when more than 60%, contents of other necessary elements such as nitrogen, calcium, chromium, manganese, etc. cannot be secured.

Calcium is necessary for increasing the addition effect of silicon and when the content is less than 0.5%, the effect is low and when more than 10%, dissolving ability into the molten iron is not good and slag including defects are apt to occur.

Nitrogen is an element for stabilizing pearlite and is essential for the additive of the present invention. When the content is less than 2.0%, amount of the additive to be used becomes too much. On the other hand, it is difficult to allow more than 10% of nitrogen to be contained in the additive.

Chromium and manganese are elements for stabilization of pearlite and are also elements incident to nitrogen. These are necessary for supplementing the pearlite forming action of nitrogen. When the content of these elements is less than 20%, the effect is small and when more than 50%, chilling tendency increases and simultaneously amounts of chromium and manganese in the return material increase.

The accompanying drawing is a graph which explains the relation between tensile strength and depth of chill when the additive of the present invention and the conventional additive are added to cast iron, respectively.

The following Examples will illustrate the present invention.

EXAMPLE 1

Particulated additives containing silicon, calcium, nitrogen and manganese, namely, Fe — 75% Si — 1.5% Ca and Fe — 70% Mn — 4.5% N were jointly added to molten iron (containing 3.31% of carbon and 2.05% of silicon). Separately, particulated additives containing silicon and calcium or manganese and nitrogen as of the conventional additives, namely, either one of said Fe — 75% Si — 1.5% Ca and Fe — 70% Mn — 4.5% N was singly added to the molten iron which was the same as mentioned above. Mechanical properties and depth of chill of thus obtained cast irons are shown in Table 2.

Table 2

| Additives | Addition amount (%) | Tensile strength (kg/mm²) | Increment and decrement of the strength | Hardness (Brinell hardness) | Increment and decrement of the hardness | Depth of chill (mm.) | Increment and decrement of the depth |
|---|---|---|---|---|---|---|---|
| Fe-75% Si-1.5% Ca + Fe-70% Mn-4.5% N | 0.8 | 29.6 | +8.3 | 210 | +25 | 3.0 | −4.5 |
| Fe-75% Si-1.5% Ca | 0.3 | 22.2 | +0.9 | 181 | −4 | 2.5 | −5.0 |
| Fe-70% Mn-4.5% N | 0.5 | 26.1 | +4.8 | 198 | +13 | 9.0 | +1.5 |
| None | — | 21.3 | 0 | 185 | 0 | 7.5 | 0 |

"Increment" and "decrement" in the above Table represent those on the basis of the values obtained when no additive was added. As is clear from Table 2, when silicon, calcium, nitrogen and manganese were simultaneously added, the synergistic effect of these elements was exhibited and tensile strength and hardness of the cast irons were markedly improved and depth of chill was decreased as compared with the cast irons obtained by singly adding either one of silicon + calcium or manganese + nitrogen. In this Example, nitriding ferromanganese was used as the nitrogen containing additive, but manganese nitride may also be used in place of the nitriding ferromanganese.

EXAMPLE 2

Particulated ferrosiliconcalcium and nitriding ferromanganese or nitriding ferrochrome (chromium nitride may also be used) were mixed to prepare three additives I, II aND III.

Compositional proportions of the elements of these additives are as shown in Table 3. The additive II is not included in the present invention and is shown for reference.

Table 3

| Additives | Si (%) | N (%) | Ca (%) | Mn (%) | Cr (%) |
|---|---|---|---|---|---|
| I | 38 | 3.2 | 1.0 | 30 | 5.2 |
| II | 60 | 1.0 | 1.5 | 25 | — |
| III | 20 | 9.8 | 8.1 | 25 | 20 |

Table 4 shows mechanical properties of cast irons when the additives as shown in the above Table were added in an amount of 0.5% to various molten irons. For comparison, the results when the conventional additive ferrosilicon was added are also shown therein.

Table 4

| C (%) | Si (%) | Additives | Tensile strength (kg/mm²) | Increment and decrement of the strength | Hardness (Brinell hardness) | Increment and decrement of the hardness | Depth of chill (mm.) | Increment and decrement of the depth |
|---|---|---|---|---|---|---|---|---|
| | | Fe—Si | 30.2 | 0 | 190 | 0 | 7.0 | 0 |
| | | I | 44.2 | +14.2 | 243 | +53 | 6.0 | −1.0 |
| 2.83 | 2.42 | II | 39.2 | +09.0 | 238 | +48 | 5.5 | −1.5 |
| | | III | 45.8 | +15.6 | 263 | +73 | 15.0 | +8.0 |
| | | Fe—Si | 26.5 | 0 | 175 | 0 | 4.5 | 0 |
| | | I | 42.0 | +16.5 | 237 | +62 | 6.0 | +1.5 |
| 2.83 | 2.86 | II | 38.1 | +11.6 | 220 | +65 | 6.0 | +1.5 |
| | | III | 42.7 | +16.2 | 251 | +76 | 12.0 | +7.5 |
| | | Fe—Si | 22.4 | 0 | 173 | | 3.0 | 0 |
| | | I | 41.7 | +19.3 | 236 | +63 | 4.0 | +1.0 |
| 2.61 | 3.04 | II | 35.3 | +12.9 | 228 | +55 | 3.5 | +0.5 |
| | | III | 44.8 | +22.4 | 245 | +72 | 8.0 | +5.0 |
| | | Fe—Si | 28.0 | 0 | 175 | 0 | 3.0 | 0 |
| | | I | 38.7 | +10.7 | 235 | +60 | 4.5 | +1.5 |
| 3.01 | 2.98 | II | 30.1 | +01.9 | 201 | +26 | 4.0 | +1.0 |
| | | III | 37.3 | +09.3 | 240 | +65 | 8.0 | +5.0 |
| | | Fe—Si | 29.2 | 0 | 185 | 0 | 4.5 | 0 |
| | | I | 37.8 | +08.6 | 226 | +41 | 5.0 | +0.5 |
| 3.26 | 2.05 | II | 33.1 | +03.9 | 210 | +25 | 5.0 | +0.5 |
| | | III | 38.9 | +09.7 | 235 | +50 | 8.5 | +4.0 |
| | | Fe—Si | 22.3 | 0 | 160 | 0 | 2.0 | 0 |
| | | I | 32.0 | +10.3 | 205 | +45 | 2.5 | +0.5 |
| 3.20 | 2.78 | II | 26.6 | +04.3 | 183 | +23 | 2.0 | 0 |
| | | III | 34.5 | +12.3 | 220 | +60 | 7.5 | +5.5 |
| | | Fe—Si | 15.7 | 0 | 145 | 0 | 2.5 | 0 |
| | | I | 29.3 | +13.6 | 187 | +42 | 3.0 | +0.5 |
| 3.22 | 3.03 | II | 23.4 | +07.7 | 160 | +15 | 2.5 | 0 |
| | | III | 30.8 | +15.1 | 205 | +60 | 7.0 | +4.5 |
| | | Fe—Si | 10.3 | 0 | 90 | 0 | 0.5 | 0 |
| | | I | 22.0 | +11.7 | 185 | +95 | 0.5 | 0 |
| 3.31 | 3.06 | II | 15.4 | +05.1 | 140 | +50 | 0.5 | 0 |
| | | III | 23.8 | +13.5 | 185 | +95 | 3.0 | +2.5 |
| | | Fe—Si | 10.1 | 0 | 105 | 0 | 0.5 | 0 |
| | | I | 23.6 | +13.5 | 168 | +63 | 1.0 | +0.5 |
| 3.40 | 3.08 | II | 18.0 | +07.9 | 145 | +40 | 0.5 | 0 |
| | | III | 24.0 | +13.9 | 170 | +65 | 3.5 | +3.0 |

The "increment" and "decrement" in the above Table represent those on the basis of the values obtained when the additive was ferrosilicon. As is clear from Table 4, tensile strength was increased by 7 – 15 kg/mm², Brinell hardness was increased by about 20 – 60 and depth of chill was nearly the same as those when ferrosilicon was added.

Next, influence of components in the additives will be explained. As is clear from Table 4, in the case of the additive I, increase in tensile strength was great and it was effective for decrease in depth of chill. On the other hand, the additive II was superior in the effect of decreasing depth of chill, but was inferior to the additive I in increase in tensile strength and the additive III resulted in remarkable increase in tensile strength, but was low in effect of decreasing depth of chill.

EXAMPLE 3

Besides the three additives as shown in Table 3, six additives IV, V, VI, VII, VIII and IX as shown in Table 5 were prepared and each of these nine additives was added to molten iron having the same compositional ratio of carbon and silicon. Mechanical properties and depth of chill of the resultant cast irons are shown in Table 6 together with the results obtained when no additive was added and when the conventional ferrosilicon additive was added.

Table 5

| Additives | Si (%) | N (%) | Ca (%) | Mn (%) | Cr (%) |
|---|---|---|---|---|---|
| IV | 45 | 2.1 | 10.0 | — | 20 |
| V | 31 | 4.2 | 3.5 | — | 48 |
| VI | 20 | 3.5 | 0.5 | 50 | — |
| VII | 55 | 2.2 | 1.0 | 20 | — |
| VIII | 51 | 2.0 | 3.5 | 7 | 13 |
| IX | 20 | 4.1 | 10.0 | 28 | 20 |

Table 6

| C (%) | Si (%) | Additives | Tensile strength (kg/mm²) | Increment and decrement of the strength | Hardness (Brinell hardness) | Increment and decrement of the hardness | Depth of chill (mm.) | Increment and decrement of the depth |
|---|---|---|---|---|---|---|---|---|
| | | None | 28.0 | | 204 | | 13.0 | |
| | | Fe-Si | 29.2 | 0 | 185 | 0 | 4.5 | 0 |
| | | I | 37.8 | +8.6 | 226 | +41 | 5.0 | +0.5 |
| | | II | 33.1 | +3.9 | 210 | +25 | 5.0 | +0.5 |
| | | III | 38.9 | +9.7 | 235 | +50 | 8.5 | +4.0 |
| 3.26 | 2.05 | IV | 35.0 | +5.8 | 220 | +35 | 5.0 | +0.5 |
| | | V | 38.2 | +9.0 | 230 | +45 | 8.0 | +3.5 |
| | | VI | 36.6 | +7.4 | 226 | +41 | 8.0 | +2.5 |
| | | VII | 35.4 | +6.2 | 222 | +37 | 4.5 | 0 |
| | | VIII | 35.2 | +6.0 | 217 | +32 | 4.5 | 0 |

Table 6-continued

| C (%) | Si (%) | Additives | Tensile strength (kg/mm²) | Increment and decrement of the strength | Hardness (Brinell hardness) | Increment and decrement of the hardness | Depth of chill (mm.) | Increment and decrement of the depth |
|---|---|---|---|---|---|---|---|---|
| | | IX | 37.9 | +8.7 | 215 | +30 | 8.5 | +4.0 |

The "increment" and "decrement" in the above Table are based on the values obtained when the additive was ferrosilicon. It is clear from Table 6, addition of the additives of the present invention resulted in improvement in mechanical properties such as tensile strength and hardness.

EXAMPLE 4

Relations between tensile strength and depth of chill of cast irons obtained when the additive I shown in Table 2 was added to molten iron in which the balance of carbon and silicon was C % = Si % and the conventional ferrosilicon additive was added to molten iron in which the balance of carbon and silicon satisfied C % = Si % + (0.7 – 1.5) are shown in the accompanying drawing. It is recognized from the drawing that when the additive of the present invention was added, a depth of chill of about 3.5 mm was obtained with Fc 30 and that of about 5 mm was obtained with Fc 40. These values correspond to depth of chill of Fc 15 and Fc 20 in the case of the conventional additive. Therefore, products which could not be produced by the conventional technique can be produced by the additive of the present invention.

The percentages used in this specification are all by weight.

What is claimed is:

1. A nitrogen containing additive for strengthening cast irons which consists essentially of 20 – 60% of silicon, 0.5 – 10% of calcium, 2.0 – 10% of nitrogen, 20 – 50% of at least one elements selected from the group consisting of chromium and manganese and the balance of iron and incidental impurity elements.

2. A nitrogen containing additive for strengthening cast irons which consists essentially of 25 – 30% of silicon, 1 – 8% of calcium, 1.0 – 5.0% of nitrogen, 35 – 45% of at least one elements selected from the group consisting of chromium and manganese and the balance of iron and incidental impurity elements.

3. A nitrogen containing additive for strengthening cast irons which consists essentially of 38% of silicon, 1% of calcium, 3.2% of nitrogen, 30% of manganese, 5.2% of chromium and the balance of iron and incidental impurity elements.

* * * * *